US008813387B2

(12) United States Patent
Grove et al.

(10) Patent No.: US 8,813,387 B2
(45) **Date of Patent: *Aug. 26, 2014**

(54) FOOTWEAR WITH SEPARABLE UPPER AND SOLE STRUCTURE

(71) Applicant: NIKE, Inc., Beaverton, OR (US)

(72) Inventors: James A. Grove, Tigard, OR (US); Eric P. Avar, Lake Oswego, OR (US); Bruce J. Kilgore, Lake Oswego, OR (US); Michael R. Friton, Portland, OR (US)

(73) Assignee: Nike, Inc., Beavertown, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/692,522

(22) Filed: Dec. 3, 2012

(65) Prior Publication Data

US 2013/0205616 A1 Aug. 15, 2013

Related U.S. Application Data

(63) Continuation of application No. 12/882,869, filed on Sep. 15, 2010, now abandoned, which is a continuation of application No. 12/207,309, filed on Sep. 9, 2008, now Pat. No. 7,814,682, which is a continuation of application No. 11/443,617, filed on May 30, 2006, now Pat. No. 7,444,763, which is a continuation of application No. 11/134,112, filed on May 19, 2005, now Pat. No. 7,076,890, which is a continuation of application No. 10/349,398, filed on Jan. 21, 2003, now Pat. No. 6,915,596.

(51) Int. Cl.
*A43B 3/24* (2006.01)

(52) U.S. Cl.
USPC ..... 36/15; 36/100; 36/61

(58) Field of Classification Search
USPC ..... 36/15, 100, 101, 61, 62
See application file for complete search history.

(56) References Cited

U.S. PATENT DOCUMENTS

| | | | |
|---|---|---|---|
| 997,657 | A | 7/1911 | Drake |
| 1,219,507 | A | 3/1917 | Teare |
| 2,178,025 | A | 10/1939 | Richter |
| 2,931,110 | A | 4/1960 | Pietrocola |

(Continued)

FOREIGN PATENT DOCUMENTS

| | | |
|---|---|---|
| BE | 493654 | 6/1950 |
| FR | 2813766 | 3/2002 |
| WO | 9746127 | 12/1997 |

OTHER PUBLICATIONS

U.S. Appl. No. 60/292,644, filed May 21, 2001, entitled "Customized Article of Footwear and Method of Conducting Retail Internet Business," by Robert M. Lyden.

(Continued)

*Primary Examiner* — Marie Bays
(74) *Attorney, Agent, or Firm* — Banner & Witcoff, Ltd.

(57) ABSTRACT

An article of footwear is disclosed that includes upper and a sole structure. The upper defines an interior void that is configured to receive the sole structure and a foot. A lower surface of the upper defines a plurality of apertures, and the sole structure includes a plurality of projections that extend through the apertures to form a ground-engaging surface. The projections are connected to a foot-supporting member that remains within the upper. A locking system is incorporated into the upper and sole structure to secure the sole structure to the upper.

18 Claims, 8 Drawing Sheets

(56) References Cited

U.S. PATENT DOCUMENTS

| | | | | |
|---|---|---|---|---|
| 3,373,510 | A | 3/1968 | Memole et al. | |
| 3,538,628 | A | 11/1970 | Einstein, Jr. | |
| 3,810,318 | A | 5/1974 | Epstein | |
| 3,846,919 | A | 11/1974 | Milotic | |
| 4,420,894 | A | 12/1983 | Glassman | |
| 4,538,368 | A | 9/1985 | Mugford | |
| 4,745,693 | A | 5/1988 | Brown | |
| 4,747,220 | A | 5/1988 | Autry et al. | |
| 4,825,563 | A | 5/1989 | Strongwater | |
| 4,850,122 | A | 7/1989 | Schwab, Jr. | |
| 4,887,369 | A | 12/1989 | Bailey et al. | |
| 4,974,344 | A | 12/1990 | Ching | |
| 5,083,385 | A | 1/1992 | Halford | |
| 5,317,822 | A | 6/1994 | Johnson | |
| 5,367,791 | A | 11/1994 | Gross et al. | |
| 5,381,610 | A | 1/1995 | Hanson | |
| 5,410,821 | A | 5/1995 | Hilgendorf | |
| 5,533,280 | A | 7/1996 | Halliday | |
| 5,661,915 | A | 9/1997 | Smith | |
| 5,799,417 | A | 9/1998 | Burke et al. | |
| 5,822,888 | A | 10/1998 | Terry | |
| 5,991,950 | A | 11/1999 | Schenkel | |
| 6,023,857 | A | 2/2000 | Vizy et al. | |
| 6,023,859 | A | 2/2000 | Burke et al. | |
| 6,145,221 | A | 11/2000 | Hockerson | |
| 6,449,878 | B1 | 9/2002 | Lyden | |
| 6,601,042 | B1 | 7/2003 | Lyden | |
| 6,915,596 | B2 | 7/2005 | Grove et al. | |
| 7,016,867 | B2 | 3/2006 | Lyden | |
| 7,076,890 | B2 | 7/2006 | Grove et al. | |
| 7,107,235 | B2 * | 9/2006 | Lyden | 705/26.5 |
| 7,444,763 | B2 | 11/2008 | Grove et al. | |
| 7,814,682 | B2 | 10/2010 | Grove et al. | |
| 2003/0051372 | A1 | 3/2003 | Lyden | |
| 2003/0069807 | A1 | 4/2003 | Lyden | |

OTHER PUBLICATIONS

U.S. Appl. No. 60/345,951, filed Dec. 29, 2001, entitled "Customized Article of Footwear and Method of Conducting Retail Internet Business," by Robert M. Lyden.

U.S. Appl. No. 60/360,784, filed Mar. 1, 2002, entitled "Customized Article of Footwear and Method of Conducting Retail Internet Business," by Robert M. Lyden.

International Search Report in related PCT Application, International Application No. PCT/US2003/037083, mailed Apr. 1, 2004.

Protest document filed by Robert M. Lyden on or about Nov. 15, 2007 in U.S. Appl. No. 11/443,617.

Second Protest document filed by Robert M. Lyden on or about Jan. 9, 2008 in U.S. Appl. No. 11/443,617.

Third Protest document filed by Robert M. Lyden on or about Jun. 6, 2008 in U.S. Appl. No. 11/443,617.

Office Action issued in Canadian Patent Application No. 2,513,473 dated Aug. 31, 2010.

Office Action issued in Canadian Patent Application No. 2,513,473 dated Oct. 19, 2011.

Office Action issued in Canadian Patent Application No. 2,513,473 dated Oct. 5, 2012.

European Search Report issued in European Patent Application No. 10179682.9 dated Feb. 15, 2011.

Communication issued in European Patent Application No. 10179682.9 dated Mar. 6, 2013.

European Search Report issued in European Patent Application No. 10179670.4 dated Apr. 7, 2011.

Notice of Reasons for Rejection issued in Japanese Patent Application No. 2009-184009 dated Feb. 8, 2012.

Notice of Reasons for Rejection issued in Japanese Patent Application No. 2009-184009 dated Nov. 29, 2012.

Notice of Reasons for Rejection issued in Japanese Patent Application No. 2012-174492 dated Oct. 24, 2013.

* cited by examiner

FOOTWEAR WITH SEPARABLE UPPER AND SOLE STRUCTURE

CROSS-REFERENCE

This non-provisional U.S. patent application is a continuation of and claims priority to U.S. patent application Ser. No. 12/882,869, which was filed in the U.S. Patent and Trademark Office on Sep. 15, 2010 and entitled "Footwear with Separable Upper and Sole Structure." U.S. patent application Ser. No. 12/882,869 is a continuation of and claims priority to U.S. patent application Ser. No. 12/207,309 (now U.S. Pat. No. 7,814,682, which issued Oct. 19, 2010), which was filed in the U.S. Patent and Trademark Office on Sep. 9, 2008 and entitled "Footwear with Separable Upper and Sole Structure." U.S. patent application Ser. No. 12/207,309 is a continuation of and claims priority to U.S. patent application Ser. No. 11/443,617 (now U.S. Pat. No. 7,444,763, which issued Nov. 4, 2008), which was filed in the U.S. Patent and Trademark Office on May 30, 2006 and entitled "Footwear with Separable Upper and Sole Structure." U.S. patent application Ser. No. 11/443,617 is a continuation application of and claims priority to U.S. patent application Ser. No. 11/134,112 (now U.S. Pat. No. 7,076,890, which issued on Jul. 18, 2006), which was filed in the U.S. Patent and Trademark Office on May 19, 2005 and entitled "Footwear With Separable Upper And Sole Structure." U.S. patent application Ser. No. 11/134,112 is a continuation application of and claims priority to U.S. patent application Ser. No. 10/349,398 (now U.S. Pat. No. 6,915,596, which issued on Jul. 12, 2005), which was filed in the U.S. Patent and Trademark Office on Jan. 21, 2003 and is entitled "Footwear With Separable Upper And Sole Structure." The present application claims priority to each of these prior U.S. patent applications, and each of these prior U.S. patent applications is entirely incorporated herein by reference.

BACKGROUND

Conventional articles of athletic footwear generally include two primary elements, an upper and a sole structure. The upper is secured to the sole structure and forms a void on the interior of the footwear for securely and comfortably receiving a foot. The upper is generally formed from multiple elements that are stitched and adhesively bonded together to form a comfortable structure for receiving the foot. Conventional athletic footwear may include, for example, an exterior formed of leather and polymer textile materials that are resistant to abrasion and provide the footwear with a particular aesthetic. Foam materials may be located on the interior of the upper to enhance the comfort of the upper, and moisture-wicking textiles may be positioned adjacent the foot to limit the perspiration within the upper.

The sole structure attenuates ground reaction forces and absorbs energy as the footwear contacts the ground, and often incorporates multiple layers that are conventionally referred to as a midsole and an outsole. The midsole forms the middle layer of the sole and serves a variety of purposes that include controlling potentially harmful foot motions, such as over pronation, and shielding the foot from excessive ground reaction forces. The outsole forms the ground-contacting element of footwear and is usually fashioned from a durable, wear resistant material that includes texturing to improve traction. The sole structure may also include an insole, which is a thin, cushioning member located within the upper and adjacent to a sole of the foot to enhance footwear comfort.

The upper and sole structure of most conventional articles of footwear are permanently secured together through adhesive bonding or stitching, for example. Accordingly, wear or damage occurring to either the upper or sole structure may require that the entire article of footwear be discarded. In addition, sole structures are generally configured for use during specific activities, particularly with athletic footwear. For example, a sole structure may incorporate pronation control elements that are beneficial for running, stability elements for court-style activities, or relatively soft cushioning for walking A sole structure that is configured for one athletic activity, such as long-distance running, may not be suitable for use during another athletic activity, such as tennis. Each different type of sole structure, therefore, requires a distinct upper in footwear where the upper and sole structure are permanently secured together.

In contrast with the conventional article of footwear that includes a permanently secured upper and sole structure, footwear configurations embodying an upper and detachable sole structure have been proposed. U.S. Pat. No. 6,023,857 to Vizy et al. discloses footwear with a permanently attached upper and outsole that includes a separate midsole and heel counter structure, which is removable from the upper. U.S. Pat. No. 5,083,385 to Halford and U.S. Pat. No. 4,974,344 to Ching both disclose an outsole structure that is detachable from the remainder of the footwear. Finally, U.S. Pat. Nos. 6,023,859 and 5,799,417 to Burke et al. disclose an article of footwear with removable and exchangeable inserts that are positioned between the upper and a lower portion of the sole structure. The inserts protrude through the lower portion of the sole structure to provide a ground-contacting surface.

SUMMARY

The present invention is an article of footwear having an upper and a sole structure. The upper includes an ankle opening and a pair of side portions extending downward from the ankle opening. The upper also includes a connection element located opposite the ankle opening and extending between the side portions. The connection element forms a bottom portion of the upper and defines an aperture. The sole structure includes a foot-supporting element and a projection connected to the foot-supporting element. The sole structure is insertable through the ankle opening such that the foot-supporting element is positioned adjacent an upper surface of the connection element and the projection extends through the aperture to provide a ground-contacting surface.

The footwear configuration described above provides separability between the upper and the sole structure. That is, the upper and sole structure may be separated into two discrete components of the footwear. During use, however, the upper and sole structure are intended to remain securely connected. In order to enhance the connection between the upper and sole structure, a locking system may be incorporated into the footwear. In an exemplary embodiment, the locking system includes an indentation in the projection that receives an edge of the aperture, thereby effectively securing the upper to the sole structure. The indentation may be positioned, for example, adjacent the foot-supporting element.

The footwear may also include additional features, including an outsole section and a textile liner. The sole structure may include a polymer foam, particularly in the projection. The outsole section, which may be formed of a rubber material, may be positioned on a lower surface of the projection to enhance the abrasion-resistance and durability of the sole structure. Similarly, the foot-supporting element may be formed of a polymer foam material. In order to enhance the comfort of the sole structure, a textile liner may be secured to the upper surface of the foot-supporting member.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION

The following discussion and accompanying FIGS. 1-8 disclose an article of footwear 10 having an upper 20 and a sole structure 30 in accordance with the present invention. In contrast with conventional articles of footwear that have a permanently-attached upper and sole structure, upper 20 and sole structure 30 are separable. This structure provides a plurality of advantages over the conventional, non-separable footwear. For example, upper 20 and sole structure 30 may be separately cleansed in a manner that best suits the respective materials forming each component. If one of upper 20 and sole structure 30 becomes worn or otherwise damaged, the damaged component may be replaced without the necessity of replacing the undamaged component. Furthermore, upper 20 and sole structure 30 may be interchanged with alternate uppers or sole structures to suit a particular activity or a preference of an individual.

Figure 1:
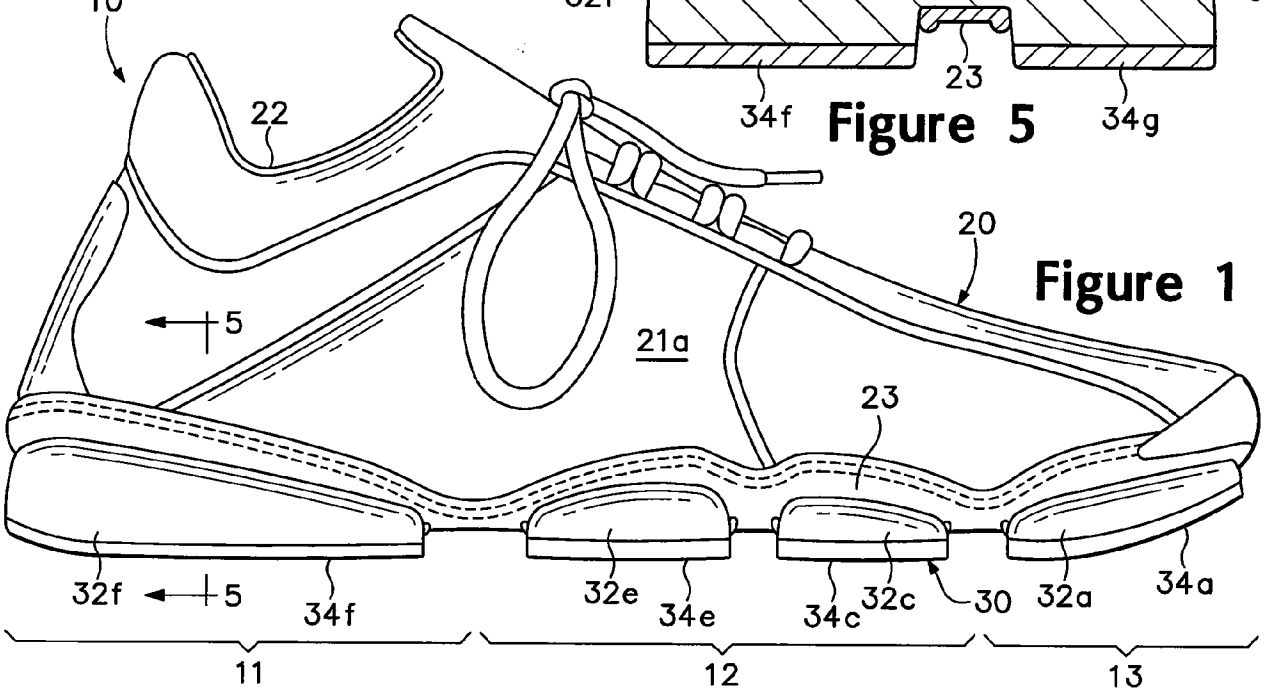
FIG. 1 is a lateral elevational view of an article of footwear having a separable upper and sole structure in accordance with the present invention.
Figure 2:
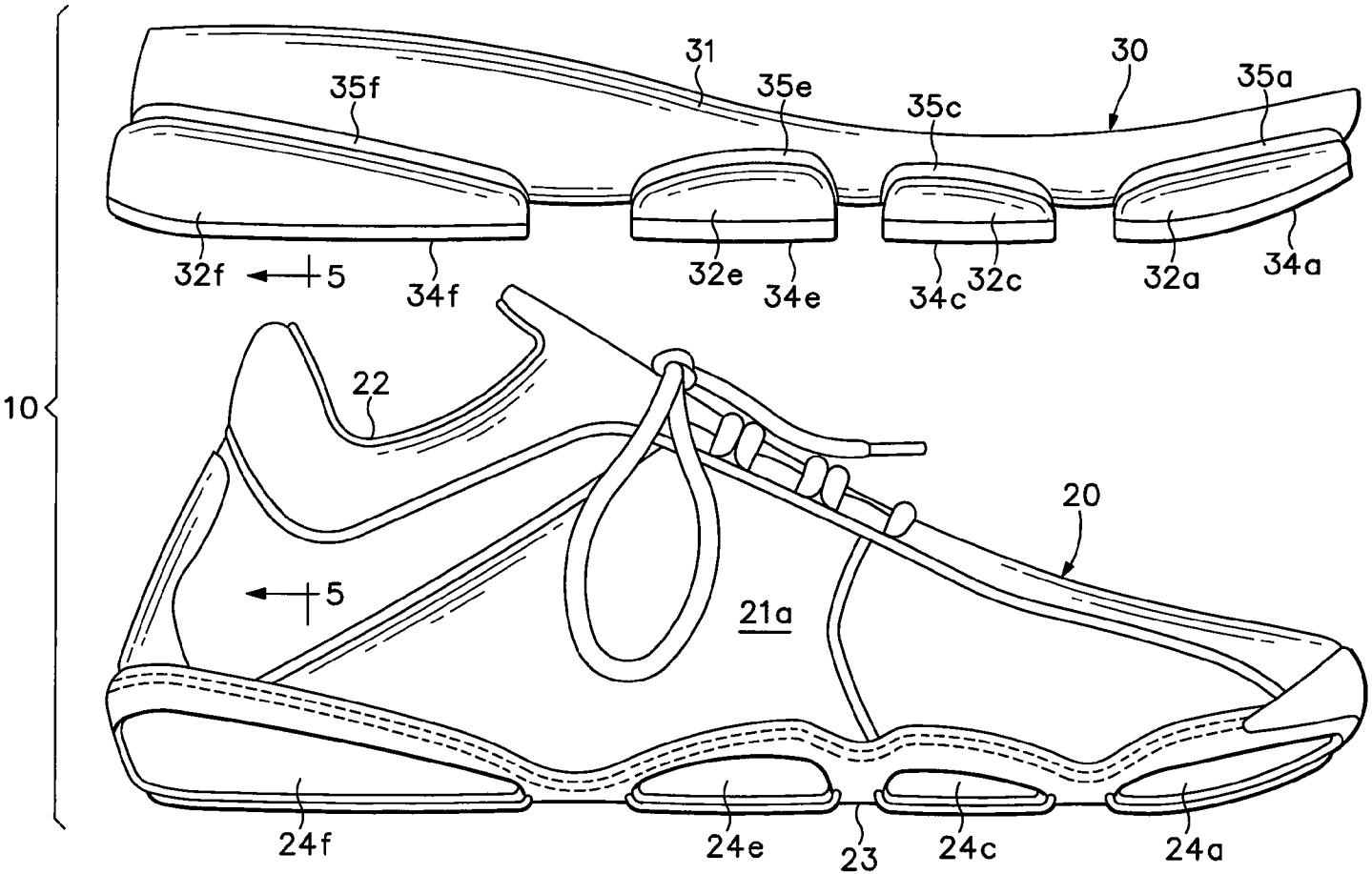
FIG. 2 is an exploded elevational view of the footwear.
Figure 3:
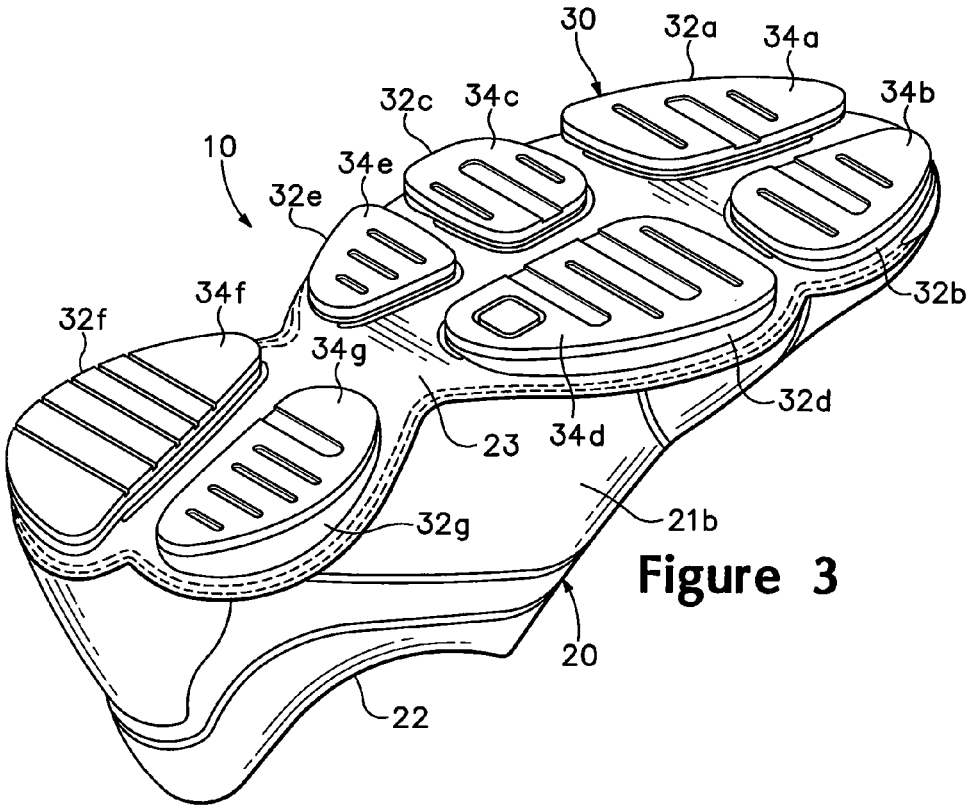
FIG. 3 is a perspective view of a bottom and medial side of the footwear.
Figure 4:
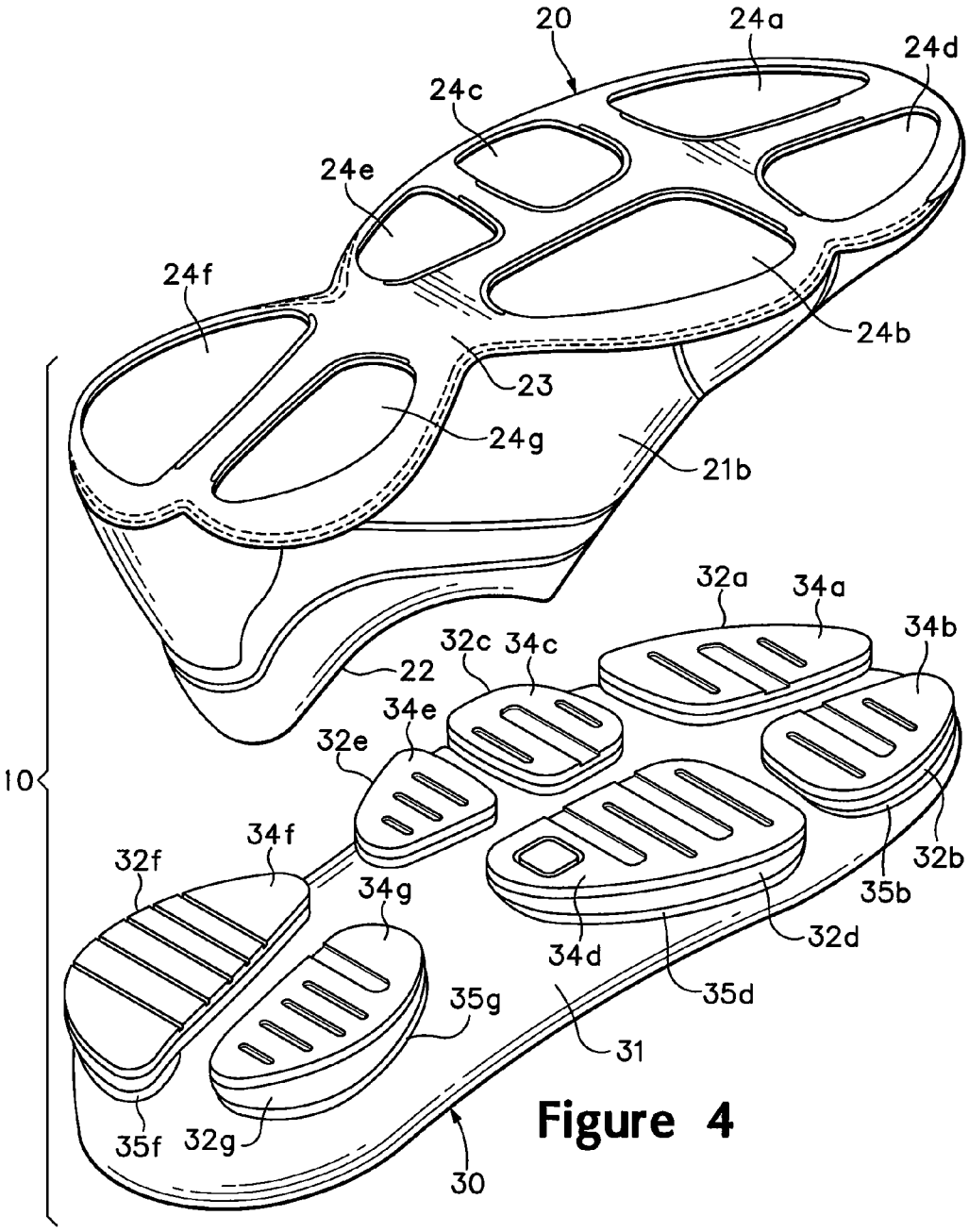
FIG. 4 is an exploded perspective view of the footwear.
Figure 6:
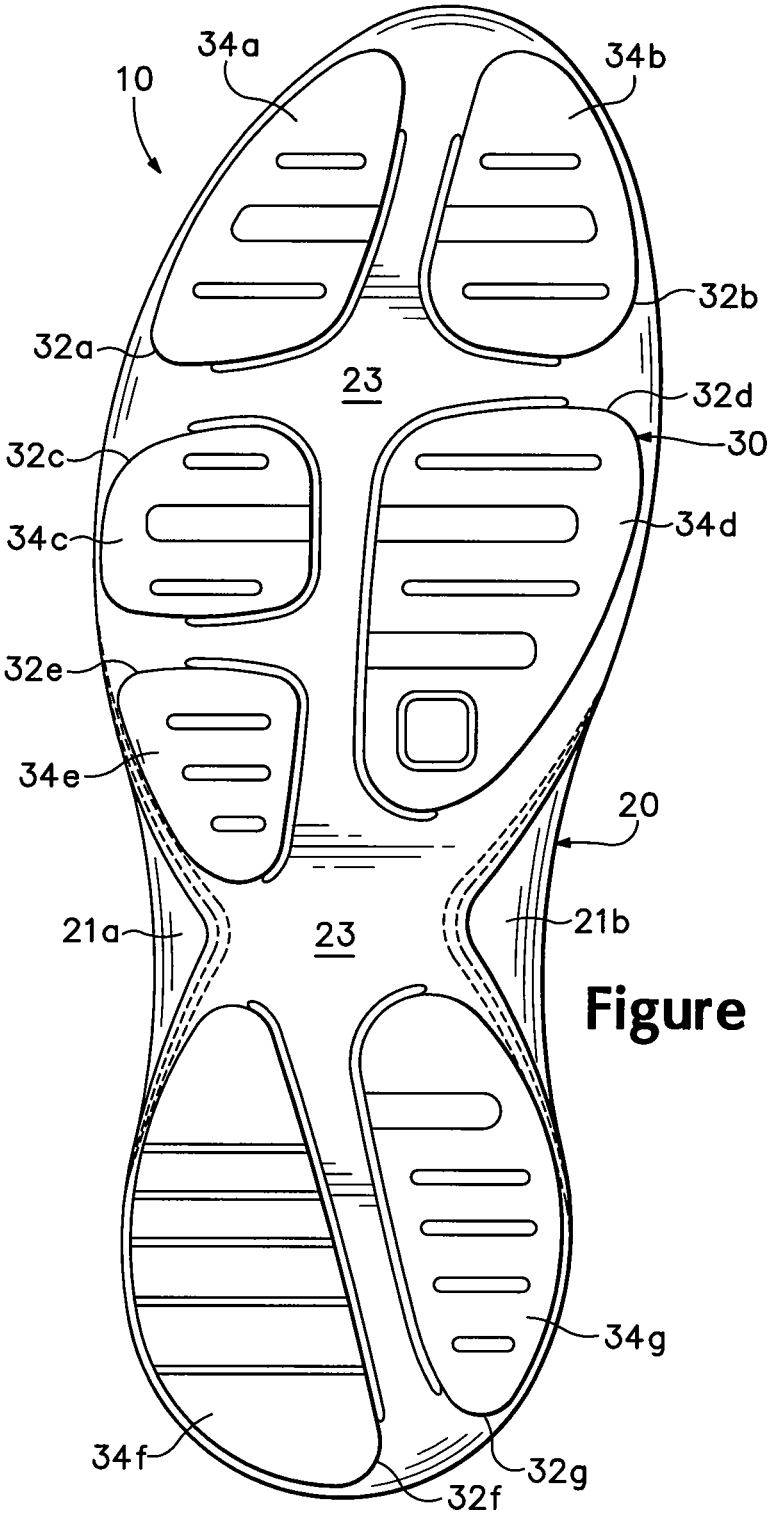
FIG. 6 is a bottom plan view of the footwear.

For purposes of reference in the following discussion, footwear 10 is divided into a heel portion 11, a midfoot portion 12, and a forefoot portion 13, as defined in FIG. 1. Heel portion 11 generally corresponds with the area of footwear 10 that receives the heel and ankle of the individual, midfoot portion 12 generally corresponds with the area of footwear 10 that receives the arch, and forefoot portion 13 generally corresponds with the area of footwear 10 that receives the toes. Portions 11-13 are not intended to demarcate precise areas of footwear 10. Rather, portions 11-13 are intended to encompass general areas of footwear 10 to aid in the following discussion.

Upper 20 incorporates a plurality of elements that are stitched or otherwise connected to form a comfortable structure for receiving the foot. Each element may include an individual material or selected textile, foam, leather, and polymer materials that are stitched or adhesively bonded together. The textile materials, for example may include a mesh cloth that provides enhanced air-permeability and moisture-wicking properties.

The foam materials may be a lightweight thermoset foam that conforms to the shape of the foot and enhances the comfort of footwear 10. Finally, the leather and polymer materials may be positioned in high-wear portions of upper 20, or in portions of upper 20 that require additional stretch-resistance or support. Accordingly, upper 20 may be manufactured from generally conventional materials.

The various elements forming upper 20 define a lateral side 21*a*, an opposite medial side 21*b*, an ankle opening 22, and a connecting element 23. Lateral side 21*a* and medial side 21*b* generally cover the sides, heel, and instep portion of the foot and may include laces or another tightening system for tightening upper 20 around the foot and securing the foot within footwear 10. Lateral side 21*a* and medial side 21*b* define ankle opening 22 and extend downward from ankle opening 22 to join with connecting element 23. Ankle opening 22 provides access to a void within upper 20 that accommodates both sole structure 30 and the foot. Upper 20 is, therefore, configured to receive sole structure 30 and the foot through ankle opening 22. Lateral side 21*a*, medial side 21*b*, and ankle opening 22 have, therefore, a generally conventional configuration. In contrast with a conventional upper, however, upper 20 includes connecting element 23, which is secured to lateral side 21*a* and medial side 21*b* and extends across a bottom of upper 20 to form a lower surface of upper 20.

Connecting element 23 is secured to a lower portion of lateral side 21*a* and medial side 21*b* to form a lower surface of upper 20. A variety of attachment techniques may be utilized for securing connecting element 23 to lateral side 21*a* and medial side 21*b*, including stitching, adhesive bonding, thermobonding, or a combination of stitching and bonding, for example. Connecting element 23 extends onto a toe area of lateral side 21*a* and medial side 21*b* in forefoot portion 13. This configuration limits forward movement of the foot relative to footwear 10. Connecting element 23 may also extend upward on the lateral side, on the medial side, or in heel portion 11.

Figure 5:
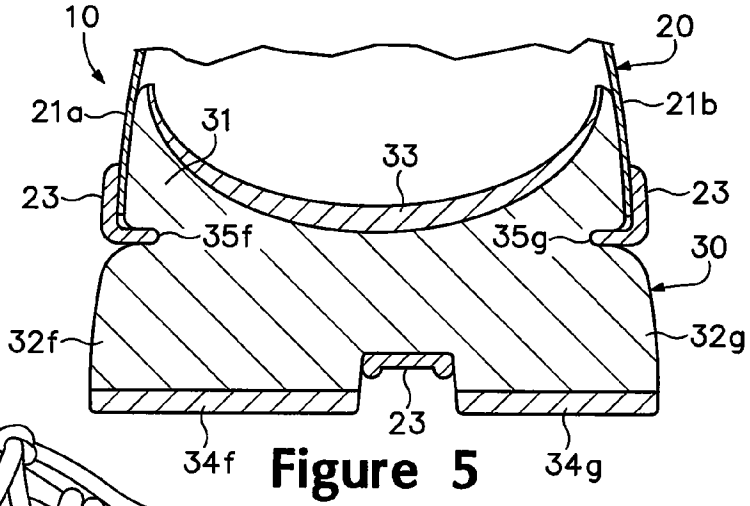
FIG. 5 is a cross-sectional view of the footwear, as defined by line 5-5 in FIG. 1.
Figure 8:
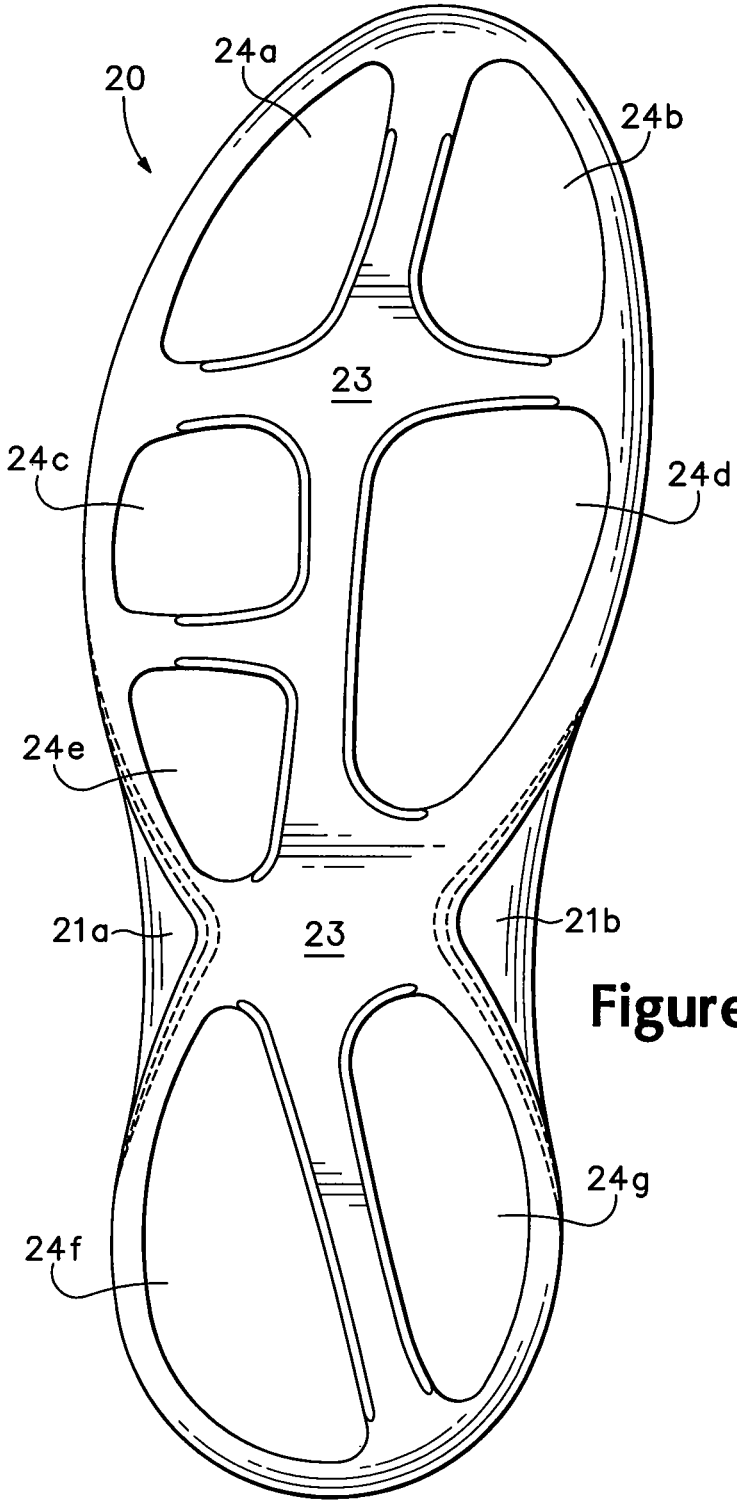
FIG. 8 is a bottom plan view of the upper.

Connecting element 23 may be a single element, as depicted in FIGS. 5 and 8, or a plurality of elements that are joined together. The primary purpose of connecting element 23 is to form a plurality of apertures 24*a*-24*g* in a lower surface of upper 20. Suitable materials for connecting element 23 include a plurality of flexible and mildly stretchable polymers, including polyether block amide, thermoplastic polyurethane, or a variety of rubber or elastomeric materials. A combination of materials may also be utilized. For example, a majority of connecting element 23 may be formed from a textile or leather material, and a polymer may be secured to the textile or leather around each of apertures 24*a*-24*g*.

Sole structure 30 is separable from upper 20 by disengaging sole structure 30 from upper 20 and drawing sole structure 30 through ankle opening 22, thereby removing sole structure 30 from the void formed within upper 20. The primary elements of sole structure 30 are a foot-supporting element 31 and a plurality of projections 32*a*-32*g*. Foot-supporting element 31 extends from heel portion 11 to forefoot portion 13 and provides an upper surface for contacting and supporting the foot. The upper surface of foot-supporting element 31 may be contoured to include a depression in heel portion 11 for seating the heel; an arch in midfoot portion 12 for supporting the arch; and an area in forefoot portion 13 for supporting forward portions of the foot, including the toes. Peripheral areas of foot-supporting element 31 may be raised to form a general depression in the upper surface of foot-supporting member 31, thereby providing an area for securely receiving the foot. In order to enhance the comfort of sole structure 30, a textile liner 33 may be attached, through adhesive bonding for example, to the upper surface of foot-supporting element 31.

A lower surface of foot-supporting element 31 contacts connecting element 23 when sole structure 30 is received by the void within upper 20. In addition, projections 32*a*-32*g* extend through apertures 24*a*-24*g*, respectively, and extend downward from upper 20 to form a ground-contacting portion of footwear 10. Each projection 32*a*-32*g* includes one of a plurality of outsole sections 34*a*-34*g* that imparts a durable and abrasion-resistant lower surface to projections 32*a*-32*g*. Suitable materials for outsole sections 34*a*-34*g* include any of the various rubber materials that are conventionally utilized in footwear outsoles, including blown rubber, carbon rubber or a combination of blown and carbon rubbers.

With the primary exceptions of liner 33 and outsole sections 34*a*-34*g*, sole structure 30 is formed of a polymer foam material that provides cushioning as footwear 10 contacts the ground. More specifically, sole structure 30 acts to attenuate ground reaction forces and absorb energy as sole structure 30 is compressed between the foot and the ground. This may occur, for example, during activities that involve walking or running Suitable materials for sole structure 30 are, therefore, any of the conventional polymer foams that are utilized in the midsoles of athletic footwear, such as ethylvinylacetate and polyurethane foam. Sole structure 30 may also incorporate a fluid-filled bladder in heel portion 11 or along the entire length of foot-supporting element 31 in order to provide additional cushioning, as disclosed in U.S. Pat. Nos. 4,183,156; 4,219,945; 4,906,502; and 5,083,361 to Marion F. Rudy, and U.S. Pat. Nos. 5,993,585 and 6,119,371 to David A. Goodwin et al.

Figure 7:
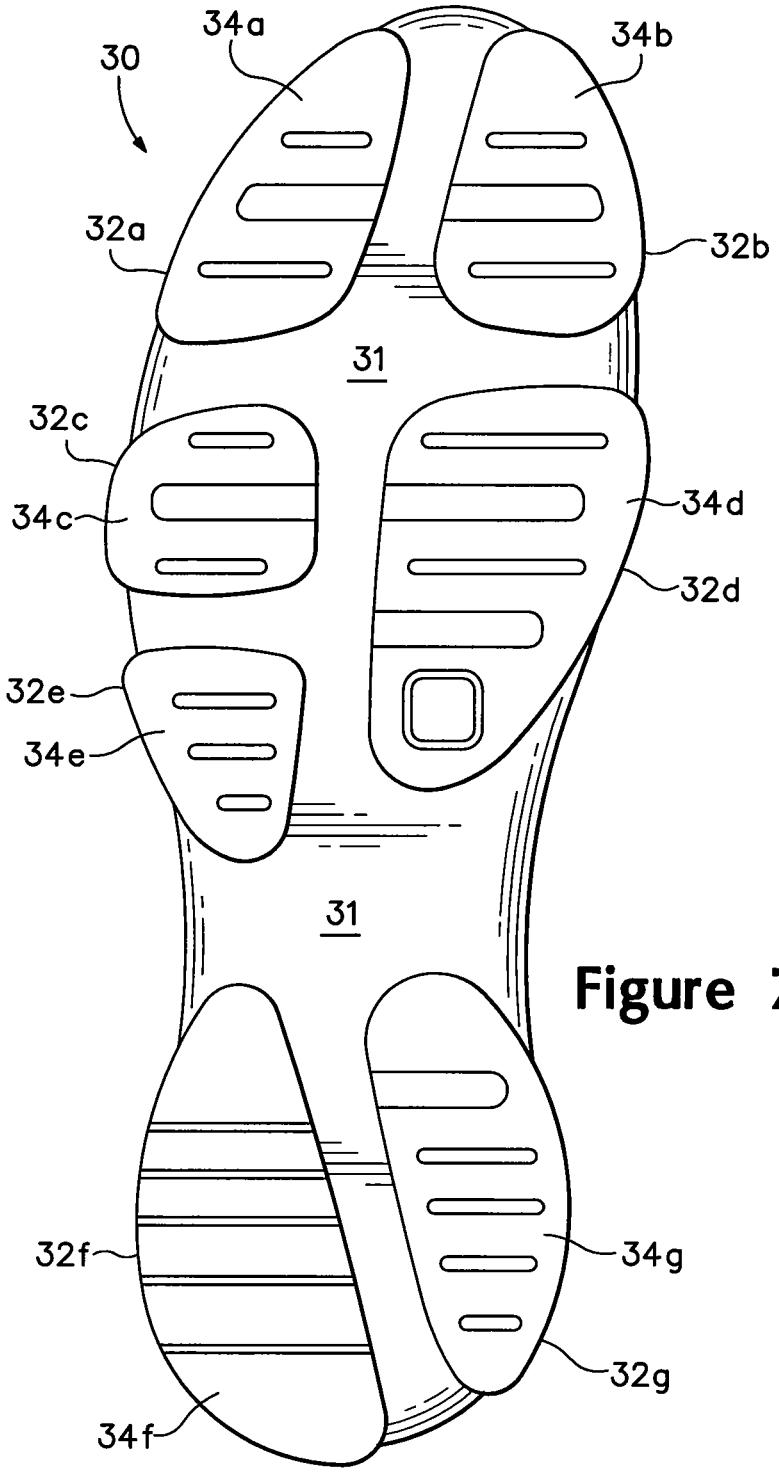
FIG. 7 is a bottom plan view of the sole structure.

Projections 32*a*-32*g* may have a variety of shapes within the scope of the present invention, including circular, elliptical, triangular, hexagonal, square, or any other geometrical or non-geometrical shape. As depicted in FIG. 7, projections 32*a*-32*g* each have different non-geometrical shapes and are distributed throughout footwear 10. More specifically, projections 32*a*-32*b* are positioned in forefoot portion 13, projections 32*c*-32*e* are positioned in midfoot portion 12, and projections 32*f*-32*g* are positioned in heel portion 11. Similarly, projections 32*a*, 32*c*, 32*e*, and 32*f* are positioned on a lateral side of footwear 10, and projections 32*b*, 32*d*, and 32*g* are positioned on a medial side of footwear 10.

When sole structure 30 is properly positioned within upper 20, projections 32*a*-32*g* extend downward and through apertures 24*a*-24*g*, respectively. The shapes of projections 32*a*-32*g* generally correspond with the shapes of apertures 24*a*-24*g* to provide a secure connection between connecting element 23 and sole structure 30. The secure connection ensures, for example, that sole structure 30 remains properly positioned relative to upper 20 during walking, running, or other ambulatory activities. The secure connection also ensures that dirt, stones, twigs and other debris do not enter upper 20 through apertures 24*a*-24*g*. In order to enhance the secure connection, apertures 24*a*-24*g* may be formed to have an area that is slightly smaller than the area of projections 32*a*-32*g*. Apertures 24*a*-24*g* may stretch, therefore, when receiving projections 32*a*-32*g*. Furthermore, projections 32*a*-32*g* may each define one of an indentation 35*a*-35*g* that extends at least partially around projections 32*a*-32*g*. Indentations 35*a*-35*g* may be utilized to receive the edges of apertures 24*a*-24*g*, thereby forming a locking system that securely connects sole structure 30 to upper 20. The area of engagement between apertures 24*a*-24*g* and projections 32*a*-32*g*, which includes indentation 35*a*-35*g*, may have approximately the same area as apertures 24*a*-24*g*, or a slightly greater area to ensure a secure connection.

The edges of apertures 24*a*-24*g* and indentations 35*a*-35*g* form the locking system that securely connects sole structure 30 to upper 20. A secure connection is generally formed when the edges of apertures 24*a*-24*g* extend into indentations 35*a*-35*g*. The connection may be enhanced, however, when the shape of the edges of apertures 24*a*-24*g* generally correspond with the shape of indentations 35*a*-35*g*. As depicted in FIG. 5, therefore, the edges of apertures 24*f* and 24*g* have a shape that corresponds with and engages the surfaces of indentations 35*f* and 35*g*. That is, the edges of apertures 24*f* and 24*g* have a generally convex shape that engages a generally concave shape formed by the surfaces of indentations 35*f* and 35*g*. In further embodiments, apertures 24*a*-24*g* and indentations 35*a*-35*g* may be structured to form other corresponding shapes. In addition, the indentations may be formed in the edges of apertures 24*a*-24*g* and projections 32*a*-32*g* may form protrusions that mate with the indentation in the edges of apertures 24*a*-24*g*.

Indentations 35*a*-35*g* may extend entirely around each of projection 32*a*-32*g*. As depicted in the figures, however, indentations 35*a*-35*g* extend only partially around each of projections 32*a*-32*g*. More specifically, indentations 35*a*-35*g* are located only on portions of projections 32*a*-32*g* that face outward from footwear 10. With respect to projection 32*c*, for example, indentation 35*c* is positioned on the lateral side of projection 32*c* and extends at least partially onto front and rear portions of projection 32*c*. Indentation 35*c* is not located, however, on the medial side of projection 32*c*.

Indentations 35*a*-35*g* receive the edges of apertures 24*a*-24*g* to form a locking system that securely connects sole structure 30 to upper 20. As discussed above, the edges of apertures 24*a*-24*g* extend into indentations 35*a*-35*g*, and the shape of the edges of apertures 24*a*-24*g* generally correspond with the shape of indentations 35*a*-35*g*. In portions of apertures 24*a*-24*g* that do not extend into indentations 35*a*-35*g*, the edge of apertures 24*a*-24*g* may have a rounded configuration, as depicted in FIG. 5, in order to increase the surface area of contact between connecting element 23 and sole structure 30.

Figure 10:
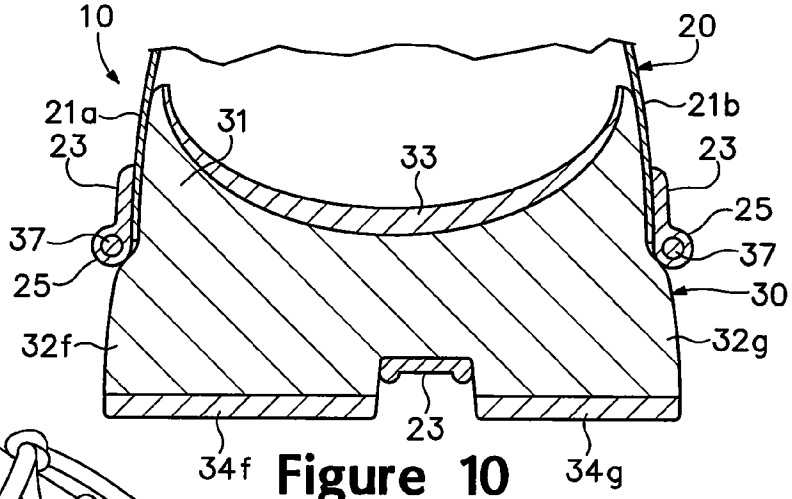
FIG. 10 is a cross-sectional view of the footwear with the alternate locking system, as defined by line 10-10 in FIG. 9.
Figure 9:
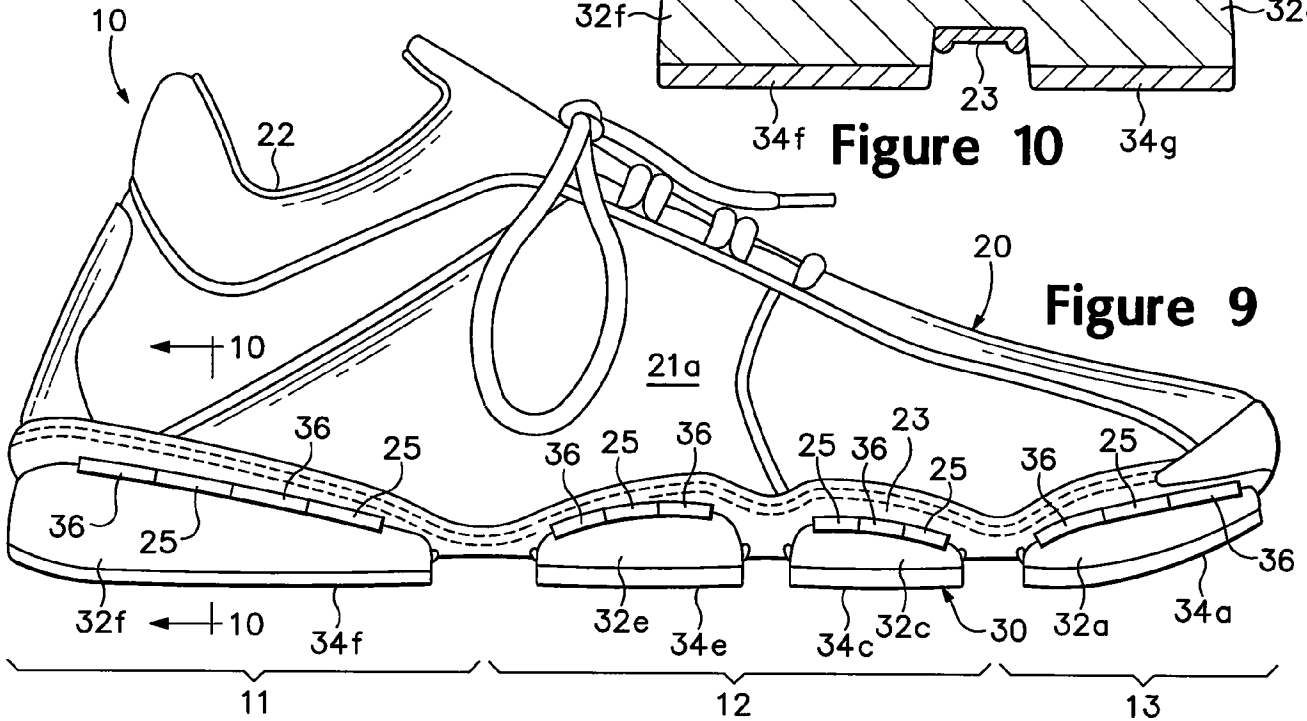
FIG. 9 is a lateral elevational view of the article of footwear with an alternate locking system.

The locking system described above provides an example of a mechanical locking system that is suitable for footwear 10. The use of an aperture edge and indentation is not the only type of mechanical locking system that may be utilized to form a secure connection between sole structure 30 and upper 20. As depicted in FIGS. 9 and 10, for example, upper 20 may include a series of tubular structures 25 that extend around connection element 23, and sole structure 30 may include a series of corresponding tubular structures 36 that align with tubular structures 25 of upper 20 and fit between tubular structures 25. Various pins 37, for example, could be placed through tubular structures 25 and 36 to secure upper 20 and sole structure 30 together. Accordingly, upper 20 and sole structure 30 have corresponding tubular structures 25 and 36 that are similar to the configuration of a hinge, with pins 37 serving the purpose of the pin in the hinge structure.

The structure of footwear 10 described above provides a variety of advantages over conventional footwear, wherein the sole is permanently attached to the upper. During running, for example, some individuals may prefer a sole structure that limits the degree to which the foot pronates upon contact with the ground. The same individual, however, may prefer a sole structure that exhibits a high degree of stability during court-style activities, such as basketball or tennis. Rather than purchase multiple pairs of upper-sole structure combinations that are permanently secured together, the individual may acquire a single upper 20 and multiple sole structures 30, each sole structure 30 being suitable for different activities. The individual may then select one of the multiple sole structures 30 for use with upper 20. Similarly, the individual may acquire multiple uppers 20 for use with a single sole structure 30.

Upper 20 and sole structure 30 are formed from different materials. Whereas a large portion of upper 20 includes textiles, sole structure 30 is primarily formed from polymer foam and rubber. Upper 20 and sole structure 30 may benefit, therefore, from cleansing techniques that are specifically suited to their respective materials. Accordingly, upper 20 may be separated from sole structure 30 and each may be cleansed in an appropriate manner.

Outsole sections 34*a*-34*g* are formed of a rubber material to provide durable, ground-contacting elements of footwear 10. Although outsole sections 34*a*-34*g* are abrasion-resistant, significant use of footwear 10 may eventually wear through portions of outsole sections 34*a*-34*g*. Rather than dispose of footwear 10, sole structure 30 may be properly recycled and replaced with an alternate sole structure 30, thus extending the lifespan of footwear 10. Similar considerations apply to upper 20.

From an aesthetic viewpoint, the interchangeability of upper 20 and sole structure 30 also provides the individual with the ability to customize the appearance of footwear 10. For example, footwear 10 may be purchased to have an upper 20 and sole structure 30 with substantially similar colors. By interchanging upper 20 with an alternate upper 20, the color combination of footwear 10 may be customized to the preferences of the individual. Support for a particular athletic team, for example, may also be demonstrated by selecting upper 20 and sole structure 30 combinations that reflect the colors of the athletic team.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An article of footwear, comprising:

an upper having an ankle opening and a connection element located opposite the ankle opening, the connection element forming at least a portion of a bottom portion of the upper, and the connection element defining a first aperture located at a lateral heel area of the connection element and a second aperture located at a medial heel area of the connection element; and a sole structure that is securable to and separable from the upper, the sole structure having a foot-supporting element, a first projection extending from a lateral heel area of the foot-supporting element, and a second projection extending from a medial heel area of the foot-supporting element, the sole structure being insertable through the ankle opening such that the foot-supporting element is positioned adjacent an upper surface of the connection element and such that the first projection extends through the first aperture and the second projection extends through the second aperture to provide a ground-contacting surface, wherein at least a portion of the foot-supporting element and the first and second projections are formed of a polymer foam material, wherein the connection element forms a first portion of a locking system and the sole structure forms a second portion of the locking system, the first portion being engagable with the second portion to secure the sole structure to the upper, wherein the locking system is a mechanical locking system.

2. The article of footwear of claim 1, when an upper surface of the foot-supporting element is contoured.

3. The article of footwear of claim 1, wherein at least a portion of a periphery of an upper surface of the foot-supporting element is raised in relation to a central area of the upper surface of the foot-supporting element.

4. The article of footwear of claim 1, wherein a heel portion of an upper surface of the foot-supporting element includes a depression for receiving a heel of a foot.

5. The article of footwear of claim 1, wherein a textile is secured to an upper surface of the foot-supporting element.

6. An article of footwear, comprising:

an upper having an ankle opening and a connection element located opposite the ankle opening, the connection element forming at least a portion of a bottom portion of the upper, and the connection element defining a first aperture located at a lateral heel area of the connection element and a second aperture located at a medial heel area of the connection element; and a sole structure that is securable to and separable from the upper, the sole structure having a foot-supporting element, a first projection extending from a lateral heel area of the foot-supporting element, and a second projection extending from a medial heel area of the foot-supporting element, the sole structure being insertable through the ankle opening such that the foot-supporting element is positioned adjacent an upper surface of the connection element and such that the first projection extends through the first aperture and the second projection extends through the second aperture to provide a ground-contacting surface, wherein at least a portion of the foot-supporting element and the first and second projections are formed of a polymer foam material, wherein the connection element forms a first portion of a locking system and the sole structure forms a second portion of the locking system, the first portion being engagable with the second portion to secure the sole structure to the upper, wherein the first portion of the locking system is: (a) an edge of the first aperture and (b) an edge of the second aperture, and wherein the second portion of the locking system is: (a) an indentation defined in the first projection of the sole structure and (b) an indentation defined in the second projection of the sole structure, the edge of the first aperture being receivable by the indentation of the first projection and the edge of the second aperture being receivable by the indentation of the second projection.

7. The article of footwear of claim 6, wherein the indentation defined in the first projection extends partially around the first projection and the indentation defined in the second projection extends partially around the second projection.

8. The article of footwear of claim 6, wherein the indentation defined in the first projection extends partially around the first projection and is located adjacent to the foot-supporting element and wherein the indentation defined in the second projection extends partially around the second projection and is located adjacent to the foot-supporting element.

9. The article of footwear of claim 6, wherein the edge of the first aperture and the indentation of the first projection have corresponding shapes, and wherein the edge of the second aperture and the indentation of the second projection have corresponding shapes.

10. An article of footwear, comprising:

an upper having an ankle opening and a connection element located opposite the ankle opening, the connection element forming at least a portion of a bottom portion of the upper, and the connection element defining a plurality of apertures including at least: (a) a first aperture located at a lateral heel area of the connection element and (b) a second aperture located at a medial heel area of the connection element; and a sole structure having a foot-supporting element and a plurality of projections connected to the foot-supporting element including at least: (a) a first projection extending from a lateral heel area of the foot-supporting element and (b) a second projection extending from a medial heel area of the foot-supporting element, the sole structure being insertable through the ankle opening such that the foot-supporting element is positioned adjacent an upper surface of the connection element and the first projection extends through the first aperture and the second projection extends through the second aperture to provide ground-contacting surfaces, wherein edges of at least a portion of the plurality of apertures and indentations in at least a portion of the plurality of projections form a locking system, the edges being joinable with the indentations to secure the sole structure to the upper.

11. The article of footwear of claim 10, wherein the indentations extend partially around the projections.

12. The article of footwear of claim 10, wherein the indentations extend partially around the at least a portion of the projections and are located adjacent to the foot-supporting member.

13. The article of footwear of claim 10, wherein the edges and the indentations have corresponding shapes.

14. The article of footwear of claim 10, where an upper surface of the foot-supporting element is contoured.

15. The article of footwear of claim 10, wherein at least a portion of a periphery of an upper surface of the foot-supporting element is raised in relation to a central area of the upper surface of the foot-supporting element.

16. The article of footwear of claim 10, wherein a heel portion of an upper surface of the foot-supporting element includes a depression for receiving a heel of a foot.

17. The article of footwear of claim 10, wherein a textile is secured to an upper surface of the foot-supporting element.

18. The article of footwear of claim 10, wherein the plurality of apertures consists of three apertures, including the second aperture, located along a medial side of the connection element and four apertures, including the first aperture, located along a lateral side of the connection element, and wherein the plurality of projections consists of three projections, including the second projection, located along a medial side of the sole structure and four projections, including the first projection, located along a lateral side of the sole structure.

* * * * *